US006454246B1

(12) United States Patent
Grifka et al.

(10) Patent No.: US 6,454,246 B1
(45) Date of Patent: Sep. 24, 2002

(54) CARBURETOR WITH SEPARATE NOZZLE POST MEMBER

(75) Inventors: Timothy K. Grifka, Ubly, MI (US); Terry O. Hendrick, Cass City, MI (US); Kevin L. Israelson, Cass City, MI (US); Eric L. King, Caro, MI (US); Albert L. Sayers, Caro, MI (US); John C. Woody, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/715,999

(22) Filed: Nov. 17, 2000

(51) Int. Cl.[7] ..... F02M 5/12
(52) U.S. Cl. ..... 261/70; 261/DIG. 39
(58) Field of Search ..... 261/70, 76, DIG. 39, 261/DIG. 75, DIG. 82

(56) References Cited

U.S. PATENT DOCUMENTS

| | | | | | |
|---|---|---|---|---|---|
| 3,469,825 | A | | 9/1969 | Du Bois | 261/71 |
| 4,464,312 | A | * | 8/1984 | Zaita | 261/70 |
| 4,757,792 | A | * | 7/1988 | Flaig et al. | 261/70 X |
| 5,133,905 | A | | 7/1992 | Woody et al. | 261/35 |
| 5,236,634 | A | | 8/1993 | Hammett et al. | 261/71 |
| 5,262,092 | A | | 11/1993 | Reeder et al. | 261/35 |
| 5,554,322 | A | | 9/1996 | Kobayashi | 261/35 |
| 5,984,281 | A | | 11/1999 | Hacker et al. | 261/71 |
| 6,003,844 | A | | 12/1999 | Konagai et al. | 261/23.2 |
| 6,003,845 | A | | 12/1999 | Kus | 261/39.4 |

FOREIGN PATENT DOCUMENTS

| | | | | |
|---|---|---|---|---|
| JP | 59-7760 | * | 1/1984 | 261/70 |
| JP | 61-138866 | * | 6/1986 | 261/70 |
| JP | 3-74554 | * | 3/1991 | 261/70 |
| JP | 4-311659 | * | 11/1992 | 261/70 |
| JP | 6-229317 | * | 8/1994 | 261/70 |
| JP | 9-158783 | * | 6/1997 | |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor has an upper body and a lower separate nozzle post member that extends into the fuel chamber of a lower fuel bowl. The nozzle post member has a main nozzle mixing passage leading from a main fuel jet inlet to a nozzle. An annular air passage and an annular idle fuel passage surround the mixing passage. The nozzle post member also has integrally formed brackets to pivotally mount the fuel float.

16 Claims, 4 Drawing Sheets

CARBURETOR WITH SEPARATE NOZZLE POST MEMBER

TECHNICAL FIELD OF THE INVENTION

The field of this invention relates to a carburetor and more particularly to a carburetor with a separate nozzle post member.

BACKGROUND OF THE INVENTION

Many carburetors have a fuel float movably mounted in a lower fuel chamber that is attached to a one-piece carburetor body for opening and closing a fuel supply valve for supplying fuel to the fuel chamber. The carburetor body generally is cast with an integrally formed upper body section with an intake passage therethrough and a tower which has an intake nozzle which extends into the lower fuel chamber. The one piece design of the tower and main body section results in a relatively thick cast section which may promote undesirable porosity. An idle fuel path, intake air passage and vent passage also passes through the tower. The fuel and air routing through the nozzle and carburetor is typically accomplished by multiple drilled holes in the casting. Many of these passages are narrow and deep such that they require multiple successive drilling operations to reach full depth. Many of these drillings are to form internal interconnections for which the exterior portion of the drilling must then be subsequently plugged. In addition, some of these drillings are not parallel or perpendicular to the throttle bore axis, i.e. they are angled which provides for a more difficult machining operation.

While many of the casting, drilling and plugging operations are automated, the high number of operations to one carburetor body adds time and thus expense to the manufacture of such carburetors. Furthermore the large casting requires an appropriately long die cast cycle time. The use of plugs also creates a risk that one may be omitted or they may create an undesirable leak path.

What is needed is an expeditiously manufactured carburetor that reduces the cost of manufacture and increases reliability.

SUMMARY OF THE INVENTION

In accordance with one aspect of the invention, a carburetor has an upper carburetor body and a lower fuel chamber carried by the body. An intake passage through the body has an air inlet and a fuel and air mixture outlet. The carburetor includes a separate nozzle post member having a flange seated onto a lower face of the upper carburetor body and a depending post that extends into the fuel chamber. The depending post has a vertical bore therethrough and a main fuel jet inlet at its lower end. A main fuel nozzle extends into the vertical bore in the depending post. The main fuel nozzle has an axially extending mixing passage therethrough with an axial end inlet for receiving fuel from the main jet inlet, at least one side aperture for allowing air to pass therein to mix with the fuel, and an outlet forming the main fuel nozzle in communication with the intake passage through the upper carburetor body.

An air passage within the depending post is adjacent the nozzle and is in communication with the side apertures and in communication with an air path through the upper carburetor body for receiving air therefrom. Preferably, the outlet of the nozzle extends laterally into the intake passage. It is also desirable that the air passage is annular in shape and circumferentially surrounds the nozzle.

The main jet fuel inlet is in communication with an idle fuel passage extending axially in the depending post and an idle fuel path in the upper carburetor body. Preferably, the idle fuel passage is annular in shape and circumferentially surrounds the annular air passage.

In accordance with one embodiment, the main fuel jet inlet is formed in an intermediate member with the nozzle extending into the intermediate member. The annular air passage is formed between the nozzle and the intermediate member. The annular idle fuel passage is formed between the intermediate member and the depending post.

It is preferable that the depending post has an integrally formed siphon passage extending downwardly with its lower opening in proximity to a floor surface of said fuel chamber.

In accordance with another aspect of the invention, the seperate nozzle post member is seated onto a lower face of the upper carburetor body and extends into the lower fuel chamber. The seperate nozzle post member has a integrally formed bracket for pivotably mounting a float valve. The float valve has a fuel valve preferably housed in the seperate nozzle post member for opening and closing a fuel supply port formed in the seperate nozzle post member.

BRIEF DESCRIPTION OF THE DRAWINGS

Reference now is made to the accompanying drawings in which.

DETAILED DESCRIPTION OF THE PREFERRED EMBODIMENT

Figure 1:
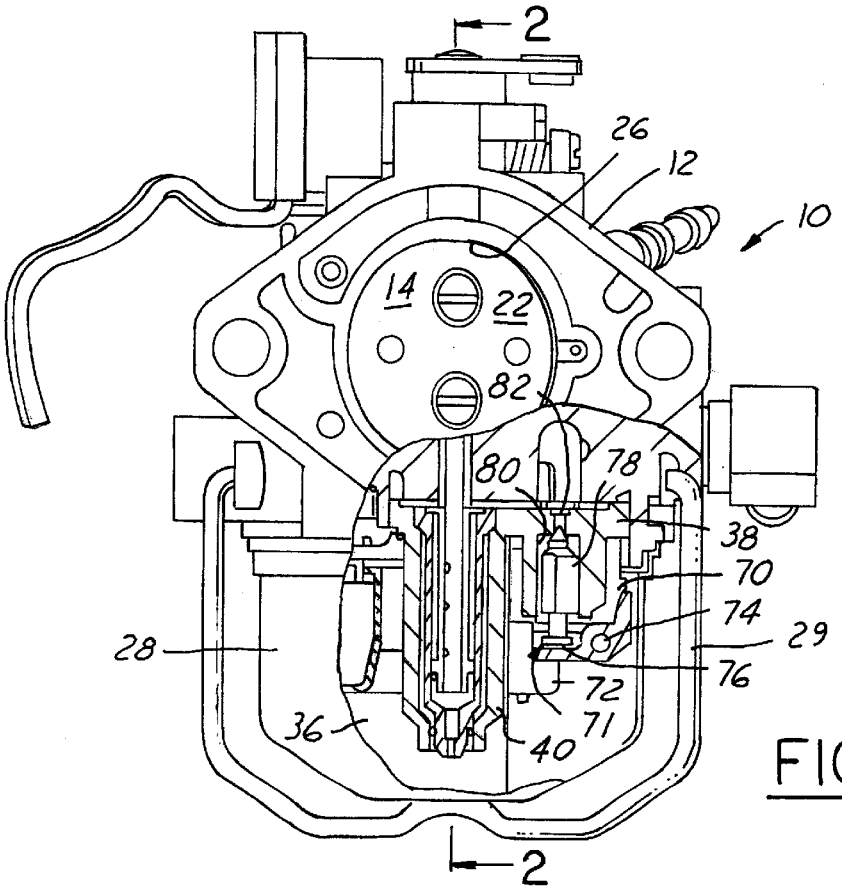
FIG. 1 is a side elevational and partially segmented view of a carburetor in accordance with an embodiment of the invention.

Referring now to FIGS. 1, 2, 7 and 8, a carburetor 10 has an upper carburetor body 12 an with an intake passage 14 therethrough. The intake passage includes a venturi section 16 with a main fuel nozzle 18 laterally positioned therein that passes through bore 92. Conventionally operated choke valve 20 and throttle valve 22 are mounted on each side of the venturi section 16 with the choke valve 20 near the inlet end 24 and the throttle valve 22 near the mixed fuel and air outlet 26.

Figure 2:
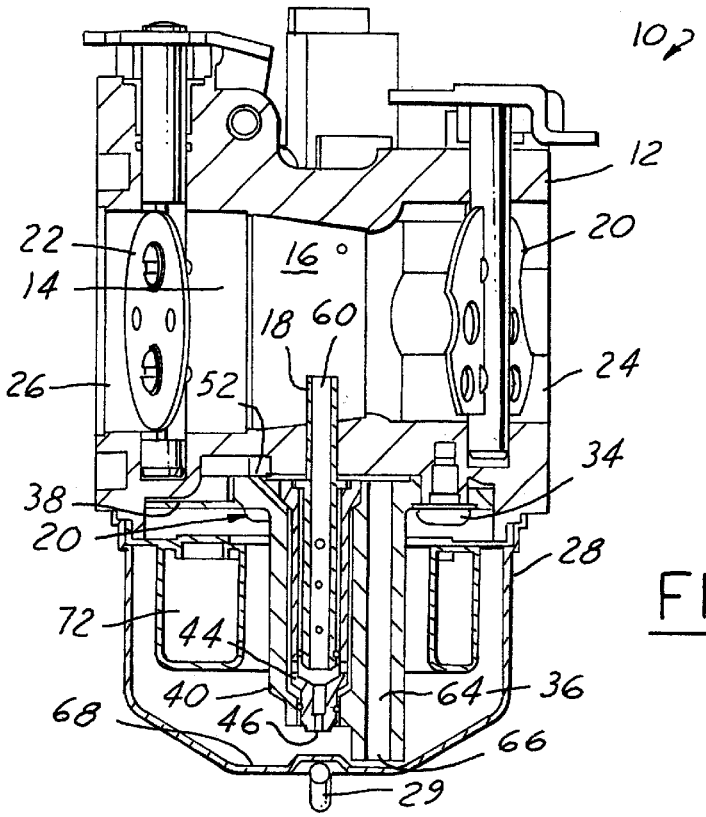
FIG. 2 is cross-sectional view taken along lines 2—2 shown in FIG. 1.

As shown in FIGS. 1 and 2, a lower fuel bowl 28 is removably connected to the upper carburetor body 12 via a pivoting bracket 29. A separate nozzle post member 30 has an upper flange 38 screwed onto the bottom face 32 of the upper carburetor body via three screws 34 shown in FIGS. 2 and 9 within the interior fuel chamber 36 of the fuel bowl 28.

Figure 4:
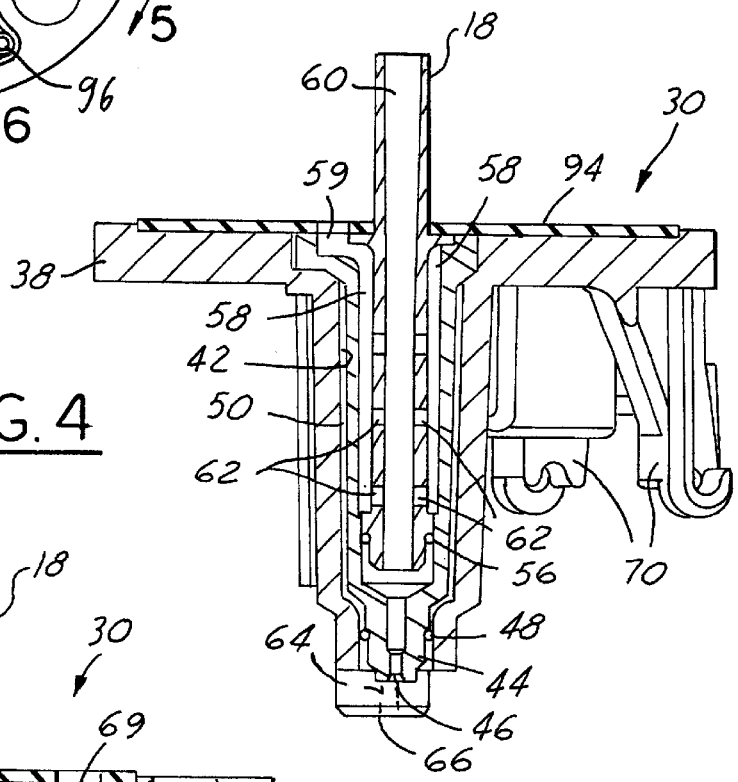
FIG. 4 is a cross-sectional view taken along the line 4—4 shown in FIG. 3.
Figure 5:
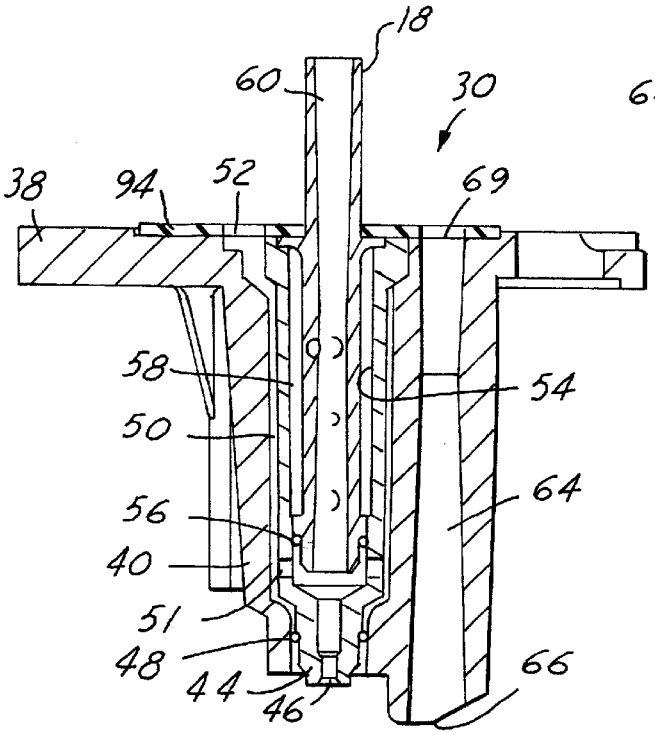
FIG. 5 is a cross-sectional view taken along the line 5—5 shown in FIG. 3.
Figure 6:
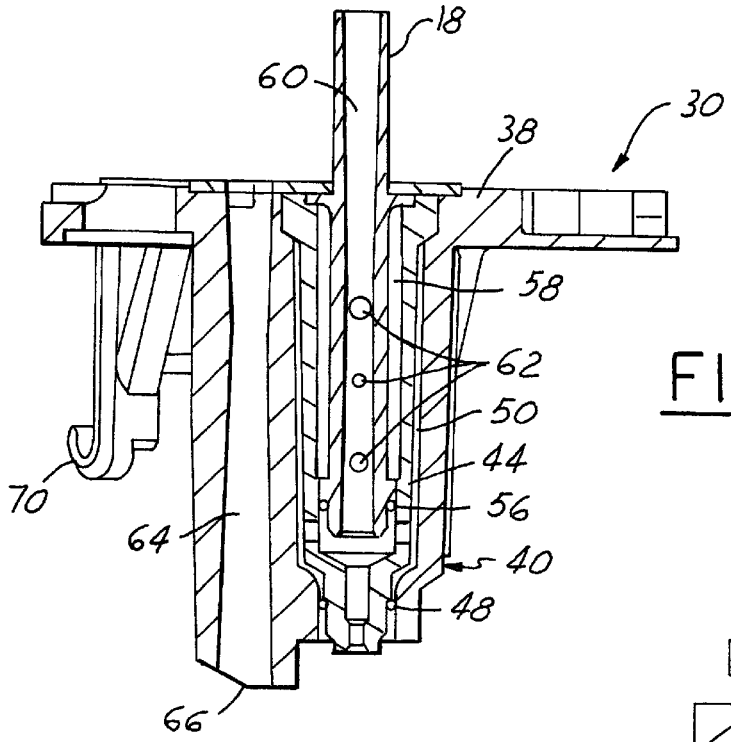
FIG. 6 is a cross sectional view taken along the line 6—6 shown in FIG. 3.
Figure 7:
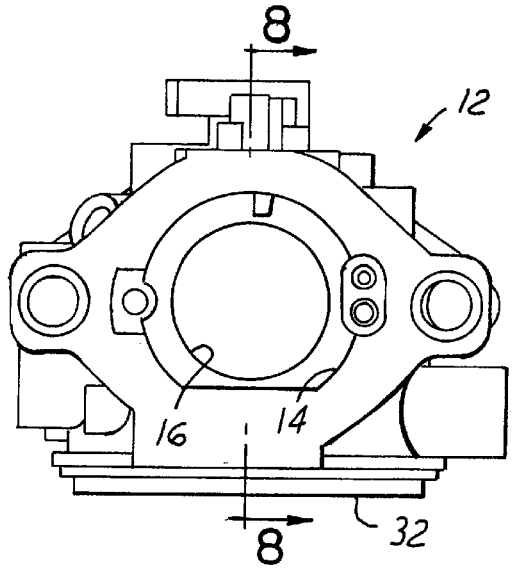
FIG. 7 is a side elevational view of the upper carburetor body shown in FIG. 1.
Figure 8:
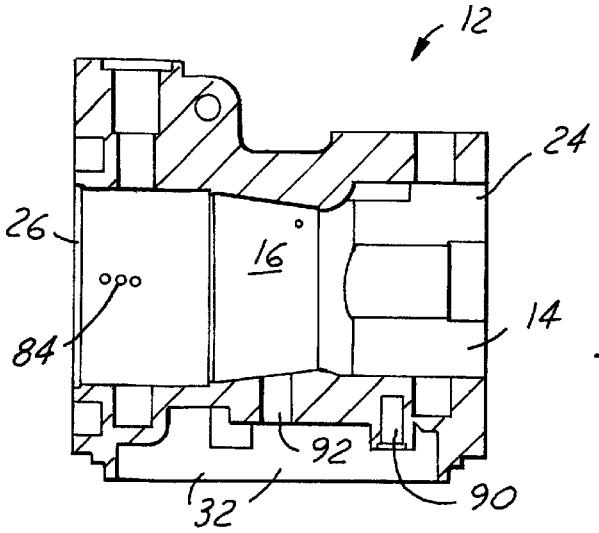
FIG. 8 is a cross-sectional view taken along line 8—8 shown in FIG. 7.

As more clearly shown in FIGS. 4, 5, and 6, the nozzle post member 30 is molded from commerically available engineered plastic material or cast from aluminum that is inert with respect to gasoline. The nozzle post member 30 has a depending post section or tower 40 with an axially extending bore 42 therethrough. The bore 42 is fitted with an intermediate member 44 that has a jet inlet 46 at its bottom end. An appropriate sealing ring 48 is fitted between the intermediate member and the tower 40. An annular idle fuel passageway 50 is formed between the tower 40 and the intermediate member 44 which is in communication with a fuel port 52 through the upper flange 38. The idle fuel passageway 50 has an upstream inlet 51 in communication with jet inlet 46 at the lower end fo central passage 54 through the intermediate member 44.

The nozzle 18 extends down into a central passage 54 in the intermediate member 44. A seal ring 56 seals the lower section of the nozzle 18 with the intermediate member 44 above the inlet 51. An annular air passage 58 is formed above the seal ring 56 between the nozzle 18 and the intermediate member 44 and is in communication with an air inlet 59 in the upper flange 38. The air passage 58 is in communication with a main fuel passage 60 in the nozzle via lateral ports 62 in the nozzle 18.

The separate nozzle member 30 also has a siphon vent 64 with an lower inlet 66 in proximity to the floor surface 68 of the fuel bowl 28 and an upper outlet 69 in flange 38.

The flange 38 also has two depending brackets 70 which pivotably connect to a float valve mechanism generally indicated at 71 as shown in FIGS. 1 and 2. The float valve mechanism 71 includes a float ring 72 that connects to the brackets 70 via a pivot pin 74. The float ring 72 includes a ledge 76, as shown in FIG. 1, that pushes up against a valve pin 78 that is housed in an inlet bore 80 of the nozzle post member 30. The valve pin 78 operably opens and closes an inlet jet 82 at the upstream end of the bore 80 that extends through the upper flange 38.

Figure 3:
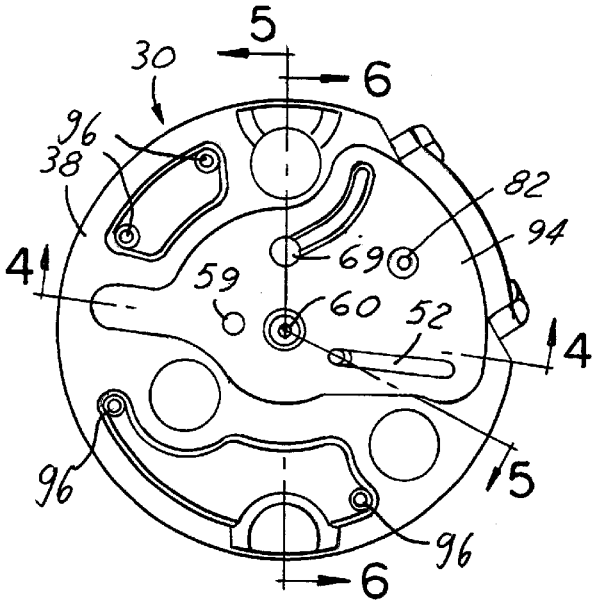
FIG. 3 is a top plan view of the separate nozzle post shown in FIG. 2.
Figure 9:
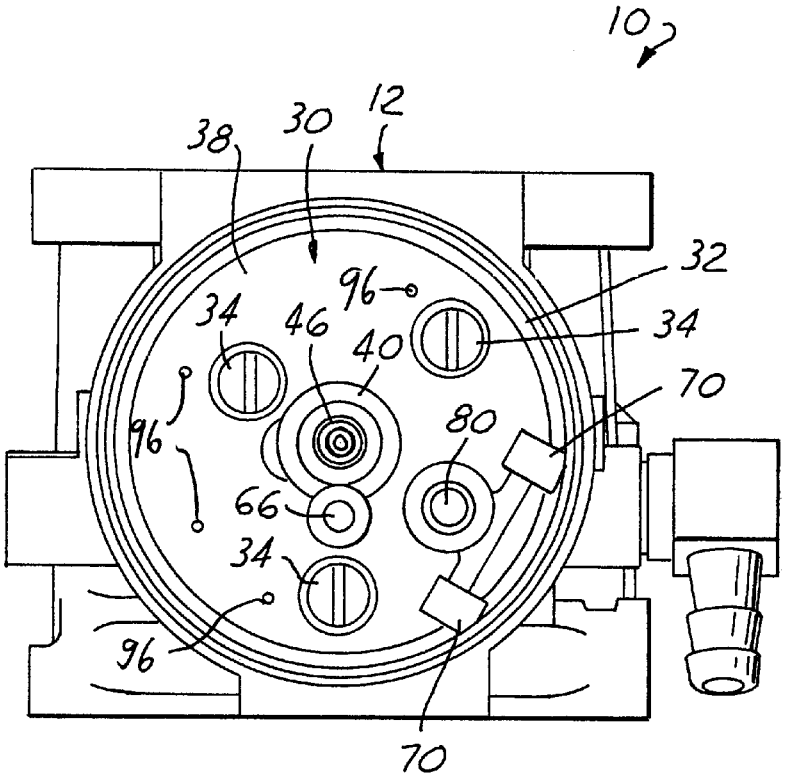
FIG. 9 is a bottom plan view of the carburetor with the fuel chamber bowl and float removed.
Figure 10:
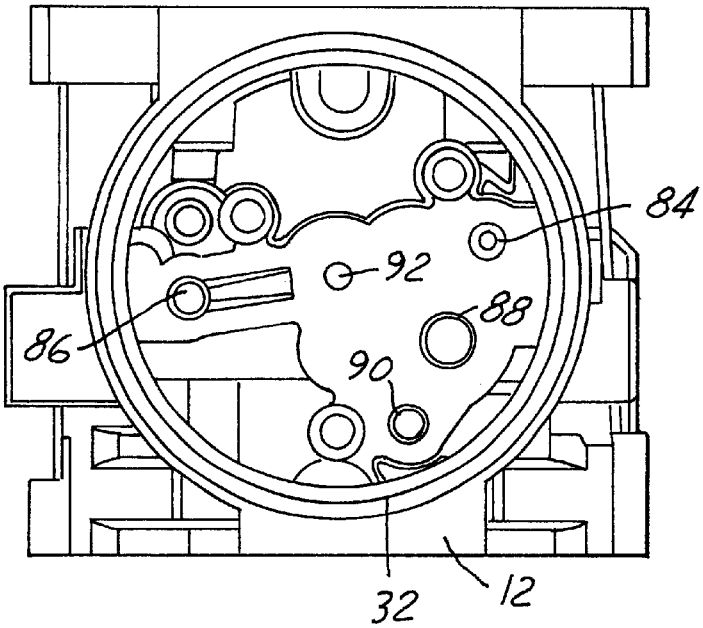
FIG. 10 is a bottom plan view of the upper carburetor body.

Referring now to FIGS. 3, 9 and 10, when the separate nozzle member 30 is mounted onto face 32 of the upper body 12, the idle fuel port 52 is in communication with an idle fuel path 84 through upper body 12, the air inlet 59 is in communication with air passage 86, inlet jet 82 is in communication with fuel supply port 88 and siphon port 69 is in communication with siphon vent 90. The main fuel nozzle 18 passes through bore 92. An appropriate gasket 94 is interposed between the flange 38 and face 32 to assure appropriate sealing and prevent undesirable crossover leakage.

In operation, the float valve mechanism 71 works in a conventional fashion. When the supply of fuel is low in the fuel bowl 28, the float ring 72 drops and ledge 76 drops to allow the pin 78 to open the inlet jet 82 to allow fuel to flow into the fuel bowl 28. When the fuel level is appropriately high, the float ring along with ledge 76 rises due to its buoyancy in the gasoline to push valve pin 78 to close off the inlet jet 82.

When the engine is operating at idle speeds, the idle fuel is aspirated from idle fuel passage 52. When the engine is operating at higher speeds, the venturi section 16 aspirates a fuel and air mixture from nozzle passage 60. The fuel is fed from the inlet jet 46 and into passage 60. The air is aspirated from the annular air passage 58 and passes through the side ports 62 in the nozzle 18 and into passage 60 to mix with the fuel therein. The seals 48 and 56 prevent undesirable crossover leakage.

The siphon passage 64 allows fuel to be siphoned out of the float bowl after an initial test run to empty the bowl for shipping. Atmospheric vent passages 96, as shown in FIGS. 3 and 9, allow air to enter into the float bowl to maintain fuel in the bowl at ambient atmospheric pressure.

The nozzle post member 30 is easily installed onto the face 32 via the screws 34 and a commercially available anaerobic thread retaining compound. In addition, the separate nozzle member 30 allows for a smaller casting for the upper body 12 and more easily constructed passages therein that eliminates all plugs. Furthermore, the flange 38 forms a splash baffle which eliminates the need for separate splash baffles which may otherwise be needed. The use of the separate nozzle post member 30 allows for the installation of an optional inlet filter screen to protect the carburetor from contamination. The separate nozzle post member 30 also provides for easy access to any of the ports and vents at the bottom face 32 of the upper body for any needed calibrations.

It is foreseen that the intermediate member 44 may also be integrally molded or formed with the nozzle post member 30 which allows for the elimination of seal ring 48. It is also foreseen that the main jet 46 may be molded in the intermediate member 44 which eliminates the need for a separate threaded and machined nozzle and pressed in jets found in conventional carburetors.

Variations and modifications are possible without departing from the scope and spirit of the present invention as defined by the appended claims.

We claim:

1. A carburetor having an upper carburetor body, an intake passage through said body having an air inlet and a fuel and air mixture outlet; and a lower fuel chamber carried by said body; said carburetor comprising:

a separate nozzle post member seated onto a lower face of said upper carburetor body and extending into said fuel chamber;

said separate nozzle post member having a depending post with a vertical bore therethrough and a main fuel jet inlet at its lower end;

a nozzle extending into said bore in said depending post, said nozzle having an axially extending mixing passage therethrough with an axial end inlet for receiving fuel from said main jet inlet, as least one side aperture for allowing air to pass therein to mix with said fuel in said mixing passage; and an outlet forming the main fuel nozzle that is in communication with said intake passage of said upper carburetor body;

an air passage within said depending post adjacent said nozzle and in communication with said side apertures and in communication with an air path in said upper carburetor body for receiving air therefrom;

said main jet fuel inlet being in communication with an idle fuel passage extending axially in said depending post and an idle fuel path in said upper carburetor body; and said idle fuel passage aligned with said idle fuel path in said upper carburetor body and sealed together against leakage by a gasket therebetween.

2. A carburetor as defined in claim 1 comprising:

said outlet of said nozzle extending laterally into said intake passage;

said air passage being annular in shape and circumferentially surrounding said nozzle; and said idle fuel passage being annular in shape and circumferentially surrounding said air passage.

3. A carburetor as defined in claim 2 further comprising:

said main jet inlet being formed in an intermediate member with said nozzle extending into said intermediate member;

said annular air passage being formed between said nozzle and said intermediate member; and said annular idle fuel passage formed between said intermediate member and said depending post.

4. A carburetor as defined in claim 3 further comprising:

said depending post having an integrally formed siphon vent extending downwardly with a lower opening in proximity to a floor surface of said fuel chamber.

5. A carburetor as defined in claim 4 further comprising:

said separate nozzle post member having an integrally formed bracket for pivotably mounting a fuel float that operably opens and shuts a fuel valve.

6. A carburetor as defined in claim 5 further comprising:

said fuel valve being seatable on a valve seat formed in said separate nozzle post member.

7. A carburetor as defined in claim 1 further comprising:

said separate nozzle post member having an integrally formed bracket for pivotably mounting a fuel float that operably opens and shuts a fuel valve.

8. A carburetor as defined in claim 7 further comprising:

said fuel valve being seatable on a valve seat formed in said separate nozzle post member.

9. A carburetor as defined in claim 1 further comprising:

said depending post having an integrally formed siphon vent extending downwardly with a lower opening in proximity to a floor surface of the fuel chamber.

10. A carburetor as defined in claim 1 further comprising:

said lower face of said upper carburetor body being substantially planar and flat and said separate nozzle post member having a substantially planar upper surface with a planar gasket forming a seal therebetween.

11. A carburetor as defined in claim 1 further comprising;

said separate nozzle post member being molded with said vertical bore, main fuel jet inlet, and branch idle fuel passage being formed when said separate nozzle post member is molded.

12. A carburetor having an upper carburetor body, an intake passage through said body having an air inlet and a fuel and air mixture outlet; a fuel chamber carried by said body; and a float valve in said chamber for selectively opening and closing a fuel supply port for filling said fuel chamber to a desired level with fuel; said carburetor comprising:

a separate nozzle post member seated onto a lower face of said upper carburetor body and extending into said fuel chamber;

said separate nozzle post member having a depending post with a vertical bore therethrough and a main fuel jet inlet at its lower end leading to a main nozzle and a branch idle fuel passage and an air pathway for mixing with fuel in said main nozzle; said separate nozzle post member having an integrally formed bracket for pivotably mounting said float valve; and said lower face of said upper carburetor body being substantially planar and flat and said separate nozzle post member having a substantially planar upper surface with a planar gasket forming a seal therebetween.

13. A carburetor as defined in claim 12, further comprising:

said float valve having a fuel valve housed in said separate nozzle post member for opening and closing said fuel supply port formed in said separate nozzle post member.

14. A carburetor as defined in claim 13 further comprising:

said separate nozzle post member having a siphon passage extending therethrough with a lower opening in proximity to a floor surface of said fuel chamber.

15. A carburetor as defined in claim 12 further comprising:

said separate nozzle post member having a siphon passage extending therethrough with a lower opening in proximity to a floor surface of said fuel chamber.

16. A carburetor as defined in claim 12 further comprising;

said separate nozzle post member being molded with said vertical bore, main fuel jet inlet, and branch idle fuel passage being formed when said separate nozzle post member is molded.

* * * * *